US007681770B2

(12) United States Patent
Kanai

(10) Patent No.: US 7,681,770 B2
(45) Date of Patent: Mar. 23, 2010

(54) STAPLER

(75) Inventor: Toshiyuki Kanai, Tokyo (JP)

(73) Assignee: Max Co., Ltd., Tokyo (JP)

( * ) Notice: Subject to any disclaimer, the term of this patent is extended or adjusted under 35 U.S.C. 154(b) by 27 days.

(21) Appl. No.: 11/661,259

(22) PCT Filed: Sep. 21, 2005

(86) PCT No.: PCT/JP2005/017359

§ 371 (c)(1),
(2), (4) Date: Feb. 27, 2007

(87) PCT Pub. No.: WO2006/035643

PCT Pub. Date: Apr. 6, 2006

(65) Prior Publication Data

US 2007/0246504 A1 Oct. 25, 2007

(30) Foreign Application Priority Data

Sep. 29, 2004 (JP) ..... 2004-284777

(51) Int. Cl.
*B25C 5/02* (2006.01)

(52) U.S. Cl. ..... 227/131; 227/8; 227/134; 227/136; 227/155; 227/156

(58) Field of Classification Search ..... 227/131, 227/155, 8, 134, 136, 156
See application file for complete search history.

(56) References Cited

U.S. PATENT DOCUMENTS

| | | | | |
|---|---|---|---|---|
| 5,460,313 | A | 10/1995 | Magnusson et al. | |
| 5,460,314 | A * | 10/1995 | Udagawa | 227/155 |
| 5,660,314 | A * | 8/1997 | Magnusson et al. | 227/2 |
| 6,626,348 | B2 * | 9/2003 | Kitamura | 227/155 |
| 6,698,640 | B2 * | 3/2004 | Hakozaki et al. | 227/4 |
| 6,719,181 | B2 * | 4/2004 | Kanai et al. | 227/2 |
| 7,014,084 | B2 * | 3/2006 | Mochizuki et al. | 227/1 |
| 2003/0042286 | A1 | 3/2003 | Yoshie | |
| 2005/0269381 | A1 * | 12/2005 | Kobayashi | 227/155 |
| 2005/0284911 | A1 * | 12/2005 | Yagi et al. | 227/131 |
| 2006/0213951 | A1 * | 9/2006 | Yagi | 227/155 |

FOREIGN PATENT DOCUMENTS

| | | | |
|---|---|---|---|
| EP | 0 605 888 | A1 | 7/1994 |
| EP | 1 112 824 | A2 | 7/2001 |
| EP | 1 160 063 | A1 | 12/2001 |
| EP | 1 166 981 | A1 | 1/2002 |
| JP | 61-166774 | U | 10/1986 |
| JP | 7-506057 | | 7/1995 |
| JP | 2001-191265 | | 7/2001 |
| JP | 2004-025548 | | 1/2004 |
| WO | WO 2004/000515 | | 12/2003 |

* cited by examiner

*Primary Examiner*—Rinaldi I. Rada
*Assistant Examiner*—Michelle Lopez
(74) *Attorney, Agent, or Firm*—Morgan, Lewis & Bockius LLP

(57) ABSTRACT

A stapler has a table formed with a clincher mechanism at a front end and is rotatably supported on a frame. A pair of locking plates slidably supported along the frame between the table and the frame prevents the clincher mechanism from rotating in a direction in which the clincher mechanism moves toward a staple driving section. Drive cams are provided independently for each of the locking plates to drive the locking plates. The times at which the respective locking plates are pulled out from between the table and the frame by the respective drive cams are shifted from each other.

6 Claims, 8 Drawing Sheets

STAPLER

TECHNICAL FIELD

The present invention relates to a stapler in which a staple formed in a U shape is driven from a staple driving section toward sheets of paper to be bound, and in which staple legs penetrating through the sheets of paper to be bound are bent along a rear face of the sheets of paper to be bound by a clincher mechanism disposed opposite to the staple driving section, thereby binding the sheets of paper to be bound.

BACKGROUND ART

There is a stapler including: a staple driving section in which a staple striking mechanism having a driver adapted to be driven by a motor is provided, and a cartridge loaded with a plurality of staples is attached; and a table which holds a clincher mechanism disposed so as to face staple legs that are struck from the staple driving section. In the stapler, the staple striking mechanism of the staple driving section is driven toward sheets of paper to be bound placed between the staple driving section and the table, and the staple inside the cartridge is struck toward the sheets of paper to be bound. The staple legs penetrating through the sheets of paper to be bound engage with the clincher mechanism held by the table, and are bent along a rear face of the sheets of paper to be bound, thereby carrying out a stapling.

The table holding the clincher mechanism at a front end thereof is supported at rear ends of side pieces that are integrally formed on both sides of the table in such a way as to be able to rotate with respect to a frame of the staple driving section. In a normal state, the table is rotated such that the clincher mechanism is moved away from an upper surface of the staple driving section. After the sheets of paper to be bound are placed between the clincher mechanism and the staple driving section, the table is rotated so as to hold the sheets of paper to be bound between the table and the upper surface of the staple driving section. Generally, the table needs to support the rear face of the sheets of paper to be bound with a load of about 8 to 10 kg against a binding load caused while the legs of the staple driven by the staple striking mechanism of the staple driving section penetrate through the sheets of paper to be bound and are bent along the rear face of the sheets of paper to be bound by the clincher mechanism formed at the front end of the table. Further, an operating stroke of the table varies in accordance with a thickness of the sheets of paper to be bound. For this reason, the table cannot be rotated directly by a cam, a linkage mechanism or the like. Accordingly, the table is operated with a spring force being applied to the cam or the linkage mechanism. However, a spring that can apply a large load is required in order to support the aforementioned binding load. Therefore, in order to operate the table against the large spring load, the driving mechanism itself is increased in size. As a result, downsizing of a stapler to be incorporated in a copy machine or the like is hampered.

JP-A-2001-191265 discloses a table locking device in which a table is biased by a relatively weak loading spring in a direction in which the table clamps sheets of paper to be bound with a staple driving section, a wedge member is fitted between a part of the table rotate by the spring biasing force and a frame, and the table is fixed by the wedge member in a closed position in which the table clamps the sheets of paper to be bound with the staple driving section. The table locking device includes: a table which is rotatably supported on a body case at a rear end thereof by a rotating support shaft and is biased to rotate in a closing direction by a torsion coil spring; an operating link operable to rotate the table in an opening direction and to hold the table in an open position; and a wedge operable to engage with a part of the table when the table operates in the closing direction, thereby preventing the table from rotating in the opening direction.

In the above described mechanism, during a normal state before a stapler is operated, the operating link is engaged with a rigid shaft which rotates integrally with the table, thereby holding the table in the open position. When the sheets of paper to be bound is placed on an upper surface of the staple driving section and the stapler is operated, the operating link disengages from the rigid shaft interlockingly with a staple striking mechanism which drives staples. As a result, the table is rotated in the closing direction due to the torsion coil spring, and the sheets of paper to be bound placed between the table and the staple driving section is clamped therebetween. As the table rotates in a direction in which it clamps the sheets of paper to be bound, the wedge member is slid by the spring force and engages with the rigid shaft that rotates integrally with the table. As a result, the table is prevented from rotating in the opening direction and is locked in the closed position in which the table clamps the sheets of paper to be bound.

In the table locking device of JP-A-2001-191265, rear ends of both side pieces that are integrally formed on both sides of the table are rotatably supported on the frame, and a pair of wedge members disposed adjacent to the side pieces engages with the rigid shaft that penetrates through the side pieces, whereby the table is locked in the closed position and the sheets of paper to be bound is clamped. Then, after a stapling is completed, in order to remove the bound sheets of paper from between the table and the staple driving section, it is necessary to pull out the pair of right and left wedge members from between the locked table and the frame and to rotate the table in the opening direction. At this time, since the wedge members are firmly fitted between the table and the frame, an initial load when pulling out the wedge members from between the table and the frame becomes very large. As a result, there arises a problem that a drive motor stops, or the drive motor is damaged due to a heat generated by an increase in current flowing through the drive motor.

DISCLOSURE OF THE INVENTION

One or more embodiments of the invention provide a stapler in which a wedge-shaped locking plate locking a table in a closed position so as to clamp sheets of paper to be bound between the table and a staple driving section can be pulled out from between the table and a frame without requiring a large driving force.

According to one or more embodiments of the invention, a table locking device of a stapler includes: a staple driving section which is formed with a staple striking mechanism operable to contain staples and to strike the staples toward sheets of paper to be bound; and a table formed with a clincher mechanism at a front end thereof, the clincher mechanism operable to bend staple legs penetrating through the sheets of paper to be bound by being struck from the staple driving section, the staple legs being bent along a rear face of the sheets of paper to be bound. The table is rotatably supported on a frame via side pieces that are integrally formed on respective sides of the table such that the clincher mechanism formed on the table faces a staple striking position of the staple driving section. A pair of locking plates supported slidably along the frame is inserted between the table and the frame, thereby preventing the table from rotating in a direction in which the clincher mechanism of the table moves away from the staple driving section. Drive cams operable to drive the locking plates are provided independently for each locking plate. Timings, at which the respective locking plates start to operate in a direction in which each of the locking plates are pulled from between the table and the frame by the respective drive cams, are set to be shifted from one another.

According to one or more embodiments of the invention, a stapler includes: a frame; a table which is rotatably supported on the frame; a pair of side pieces which is integrally formed on respective sides of the table in order to rotatably support the table; a first and a second locking plates which are slidable along the frame between a position in which the table is prevented from rotating and a position in which the table is allowed to rotate; and a first and a second drive cams operable to drive the first and the second locking plates respectively.

According to one or more embodiments of the invention, a first timing, at which the first drive cam starts to drive the first locking plate to move from the position in which the table is prevented from rotating to the position in which the table is allowed to rotate, and a second timing, at which the second drive cam starts to drive the second locking plate to move from the position in which the table is prevented from rotating to the position in which the table is allowed to rotate, are shifted.

According to one or more embodiments of the invention, the stapler includes: a staple driving section disposed in a lower portion of the frame; and a clincher mechanism disposed at a front portion of the table. The clincher mechanism faces a staple striking position of the staple driving section, and the clincher mechanism moves toward or moves away from an upper surface of the staple driving section in accordance with a rotation of the table.

According to one or more embodiments of the invention, when the first and second locking plates are in the position in which the table is prevented from rotating, the clincher mechanism is prevented from moving in a direction away from the staple driving section.

Further, the table is biased in a direction in which the clincher mechanism moves toward the staple driving section.

According to one or more embodiments of the invention, the stapler includes: a rotation lever which is rotatably supported on the frame; and a projection which is engageable with the rotation lever, the projection being formed on each of the pair of side pieces. The table rotates in the direction in which the clincher mechanism moves away from the staple driving section in accordance with the rotation of the rotation lever.

According to one or more embodiments of the invention, each of the first and second locking plates engages with the corresponding projection in the position in which the table is prevented from rotating.

Further, the first cam face formed on the first drive cam and the second cam face formed on the second drive cam are different in shape.

The other features and advantageous effects are obvious from the description of embodiments and the appended claims.

DESCRIPTION OF REFERENCE NUMERALS

1 Stapler
2 Frame
3 Staple driving section
5 Table
6 Drive shaft
9 Side piece
11 Clincher mechanism
15 Projection (each side piece of table)
16*a*, 16*b* Locking plates
19*a*, 19*b* Operating levers
24*a*, 24*b* Drive cams
26*a*, 26*b* Cam faces

BEST MODE FOR CARRYING OUT THE INVENTION

Hereinafter, an embodiment of the invention will be described in accordance with the drawings.

Embodiment 1

Figure 1:
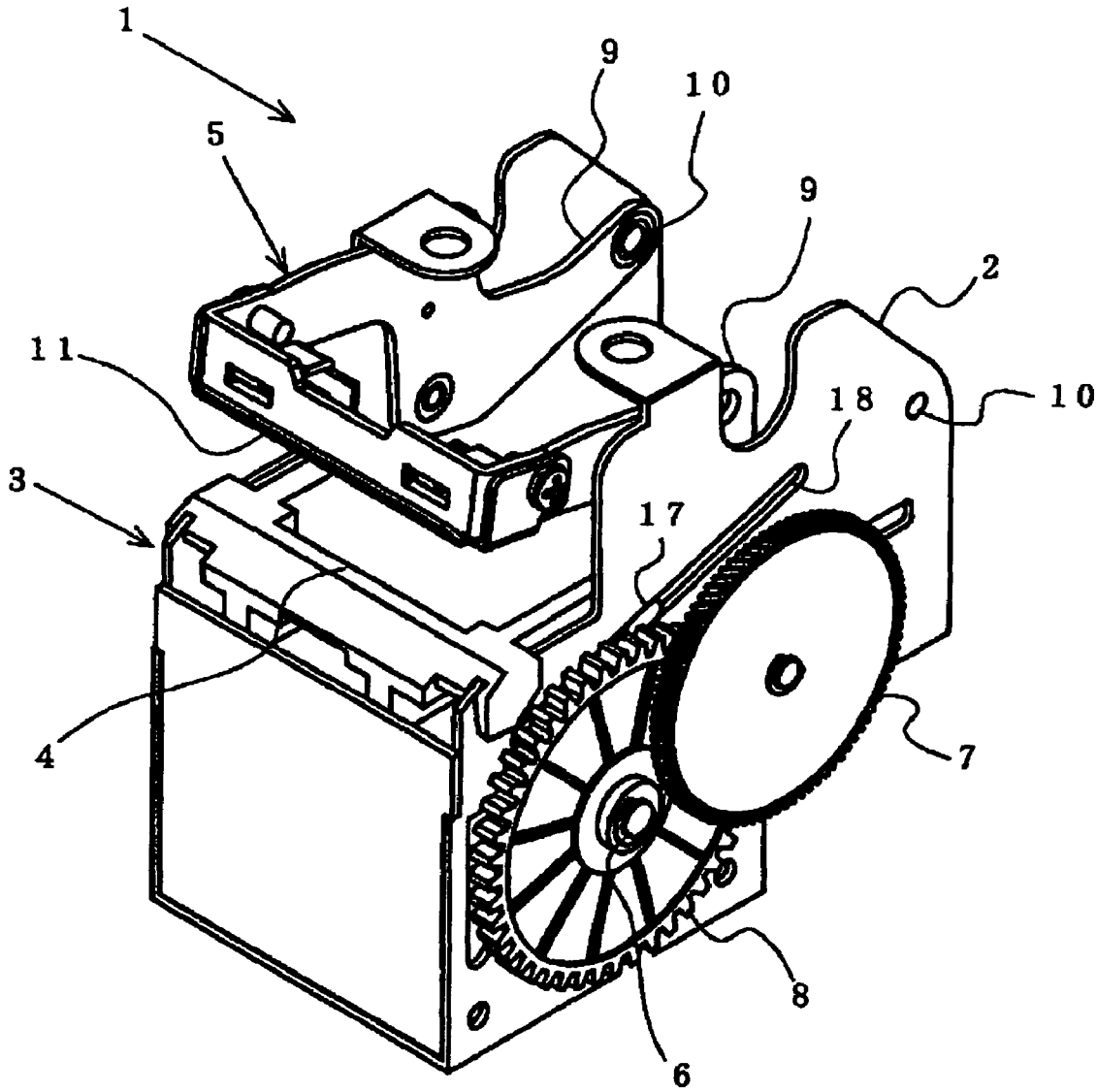
FIG. 1 A perspective view of a stapler.

FIG. 1 shows a stapler according to an embodiment of the invention. A staple cartridge loaded with staple sheets in which linear staple materials are connected in parallel is attached to the stapler 1. The exterior of the stapler 1 is formed by a frame 2. In a lower portion of the frame 2, there is provided a staple supply mechanism operable to sequentially supply the staple sheets in the staple cartridge toward a staple driving section 3, a staple forming mechanism operable to form the linear staple materials supplied to the staple driving section 3 into U-shaped staples, and the staple driving section 3 having a staple striking mechanism operable to strike the U-shaped staples toward sheets of paper to be bound.

Further, a table 5 is provided in an upper portion of the frame 2, the table 5 being rotatably supported on the frame 2 at a rear end thereof so as to clamp the sheets of paper to be bound placed on an upper surface 4 of the staple driving section 3 between the table 5 and the upper surface 4 of the staple driving section 3. The frame 2 is provided with a drive shaft 6 penetrating through the frame 2, the drive shaft 6 being provided with drive cams, etc. for driving the staple supply mechanism, the staple forming mechanism, the staple striking mechanism and the table 5. The drive shaft 6 is adapted to be rotated by a motor provided inside the frame 2, via a reduction gear 7 disposed on a side surface of the frame 2 and a drive gear 8 fixed to the drive shaft 6.

Figure 2:
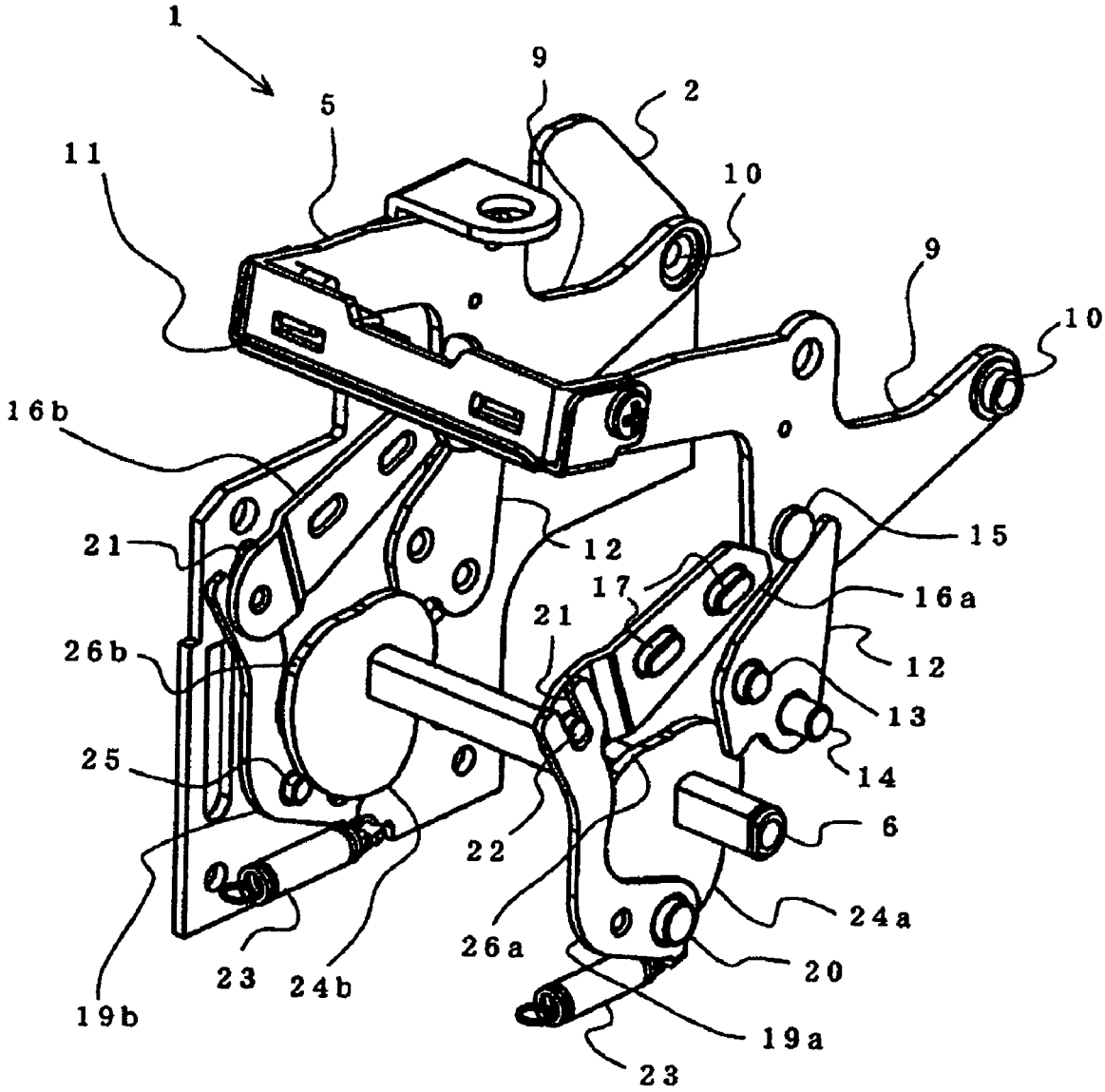
FIG. 2 A perspective view showing a driving mechanism of a table of the stapler shown in FIG. 1.

As shown in FIG. 2, side pieces 9 (a pair of side pieces 9) extending rearward are integrally formed on respective sides of the table 5. Rear ends of the respective side pieces 9 are supported on the frame 2 by supporting shafts 10. A front of the table 5 rotates about the supporting shafts 10 so as to move toward or away from the upper surface 4 of the staple driving section 3. A clincher mechanism 11 is formed at the front of the table 5, the clincher mechanism 11 being disposed so as to face the staple legs to be struck from the staple driving section 3. The legs of a staple driven by the staple striking mechanism of the staple driving section 3 penetrate through the sheets of paper to be bound, and are bent along an rear face of the sheets of paper to be bound by the clincher mechanism 11. In a normal state, the table 5 is biased by a not-shown biasing spring or the like to rotate in a closing direction in which the clincher mechanism 11 moves toward the upper surface 4 of the staple driving section 3.

Rotation levers 12 are provided adjacent to both side pieces 9 of the table 5 such that the rotation levers 12 are rotatably supported on the frame 2 by supporting shafts 13. In a initial state, the rotation levers 12 are disposed in a position in which the rotation levers 12 are rotated counterclockwise as seen in FIG. 2. In thus rotated position, the rotation levers 12 engage with projections 15 formed on outer side surfaces of the respective side pieces 9 of the table 5. Accordingly, the table 5 is rotated about the supporting shafts 10 in an opening direction in which the clincher mechanism 11 moves away from the upper surface 4 of the staple driving section 3, and the table 5 is held in thus rotated position. Outwardly projecting drive pins 14 formed on the respective rotation levers 12 engage with the drive cams (not shown) provided to the drive shaft 6, whereby the rotation levers 12 rotate about the supporting shafts 13. The rotation levers 12 are rotated clockwise at the beginning of a stapling operation, whereby the rotation levers 12 move away from the projections 15 of the table 5, and allows the table 5 to rotate counterclockwise.

Further, the frame 2 is provided with locking plates 16*a*, 16*b* (a first locking plate 16*a* and a second locking plate 16*b*) which are slidable along the frame 2 in a state in which the locking plates 16*a*, 16*b* are adjacent to the respective side pieces 9 of the table 5. Projections 17 that are integrally formed on the respective locking plates 16*a*, 16*b* are movably fitted in each of elongated holes 18 formed on the frame 2. The locking plates 16*a*, 16*b* are supported on the frame 2 in such a way as to be slidable along the elongated holes 18. When the rotation levers 12 are rotated clockwise and the table 5 is rotated counterclockwise by a biasing force of the biasing spring, the locking plates 16*a*, 16*b* are slid along the elongated holes 18 in a right direction as seen in the figures. Then, the locking plates 16*a*, 16*b* move to upper sides of the projections 15 formed on the respective side pieces 9 of the table 5, and engage with the projections 15. Accordingly, the table 5 is prevented from rotating clockwise.

When the legs of the staple penetrating through the sheets of paper to be bound by being struck from the staple driving section 3 abut against the clincher mechanism 11 of the table 5 that is rotated to a closed position, a binding load for bending the staple legs acts on the table 5. For this reason, a force acts on the table 5 in a direction in which the table 5 rotates clockwise. However, the locking plates 16*a*, 16*b* move to the upper side of the projections 15 formed on the respective side pieces 9 of the table 5 and prevent the projections 15 from rotating upward, thereby preventing the table 5 from rotating clockwise. In this way, the locking plates 16*a*, 16*b* engage with the projections 15 formed on the side pieces 9 of the table 5, and the rotation of the table 5 is locked, whereby the table 5 can be reliably held in the closed position even when a large binding load is applied to the clincher mechanism 11.

Operating levers 19*a*, 19*b* are rotatably supported on the frame 2, and are linked to the pair of corresponding locking plates 16*a*, 16*b*. Via the operating levers 19*a*, 19*b*, the locking plates 16*a*, 16*b* are made to slide between a position in which the locking plates 16*a*, 16*b* are moved to the upper sides the projections 15 (a position in which the table is prevented from being rotated) and a position in which the locking plates 16*a*, 16*b* are retracted from the upper side of the projections 15 (a position in which the table is allowed to rotate). The operating levers 19*a*, 19*b* are rotatably supported with respect to the frame 2 by supporting shafts 20 formed on respective ends of the operating levers 19*a*, 19*b*. Operating pins 22 integrally formed on respective rear ends of the locking plates 16*a*, 16*b* are movably fitted in recessed grooves 21 formed on the other ends of the operating levers 19*a*, 19*b*, whereby the locking plates 16*a*, 16*b* and the operating levers 19*a*, 19*b* are linked. When the operating levers 19*a*, 19*b* rotate about the supporting shafts 20 clockwise, the locking plates 16*a*, 16*b* operate so as to move to the upper side of the projections 15. When the operating levers 19*a*, 19*b* rotate about the supporting shafts 20 counterclockwise, the locking plates 16*a*, 16*b* move to a retracted position in which the locking plates 16*a*, 16*b* are retracted from the upper sides of the projections 15.

Springs 23 are provided at respective lower ends of the operating levers 19*a*, 19*b* so as to bias the operating levers 19*a*, 19*b* to rotate. The springs 23 bias the operating levers 19*a*, 19*b* to rotate clockwise. In this way, the locking plates 16*a*, 16*b* are constantly biased so as to move to the upper sides of the projections 15. Further, for each of the operating levers 19*a*, 19*b*, drive cams 24*a*, 24*b* (a first drive cam 24*a* and a second drive cam 24*b*) are provided so as to face the corresponding operating levers 19*a*, 19*b* and to rotate the operating levers 19*a*, 19*b*. When the operating levers 19*a*, 19*b* rotate counterclockwise via the drive cams 24*a*, 24*b* that are attached to the drive shaft 6, the locking plates 16*a*, 16*b* move to the position in which the locking plates 16*a*, 16*b* are retracted from the upper sides of the projections 15. The operating levers 19*a*, 19*b* are formed with drive pins 25, each engaging with respective cam faces 26*a*, 26*b* formed on the drive cams 24*a*, 24*b*. The operating levers 19*a*, 19*b* rotate counterclockwise by rotating the drive cams 24*a*, 24*b* with the drive shaft 6. In this way, the locking plates 16*a*, 16*b* move to the retracted position to which the locking plates 16*a*, 16*b* are retracted from the upper sides of the projections 15.

Figure 3:
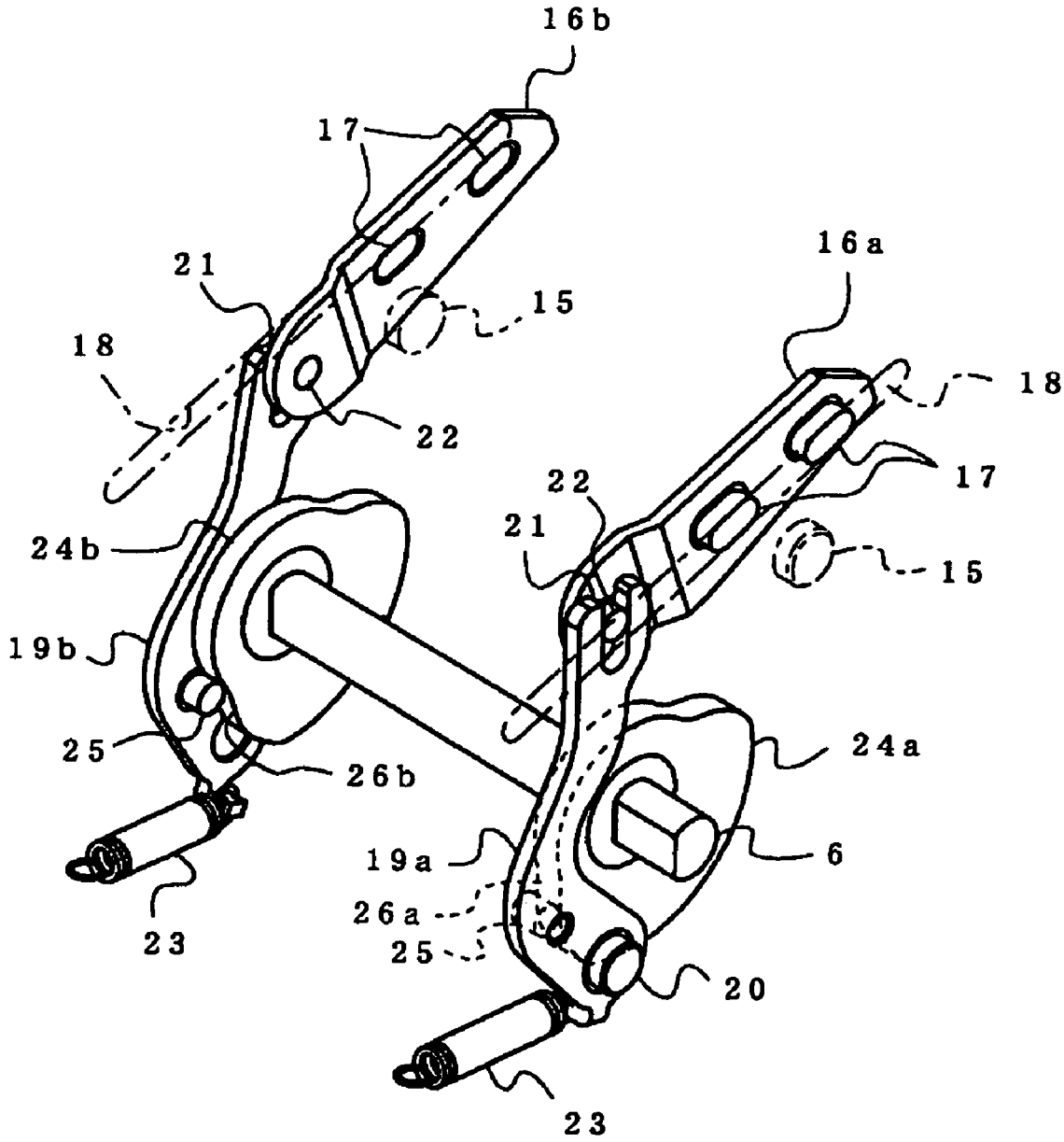
FIG. 3 A perspective view showing a table locking device of the stapler shown in FIG. 1.

As shown in FIG. 3, the cam faces 26*a*, 26*b* (a first cam face 26*a* and a second cam face 26*b*) are formed on the drive cams 24*a*, 24*b* which rotates the operating levers 19*a*, 19*b* in engagement with the drive pins 25 of the operating levers 19*a*, 19*b*, are adapted to retract the pair of locking plates 16*a*, 16*b*, each at different timings, from the upper sides of the projections 15 formed on the side pieces 9 of the table 5. More specifically, the respective cam faces 26*a*, 26*b* of the drive cams 24*a*, 24*b* are formed such that a timing, at which the cam face 26*a* of the drive cam 24*a* operating the operating lever 19*a* linked to one of the locking plates 16*a* starts to rotate the operating lever 19*a* counterclockwise in engagement with the operating pin 25 of the operating lever 19*a*, is earlier than a timing, at which the cam face 26*b* of the drive cam 24*b* operating the operating lever 19*b* linked to the other locking plate 16*b* starts to rotate the operating lever 19*b* counterclockwise in engagement with the operating pin 25 of the operating lever 19*b*. In other words, the first cam face 26*a* and the second cam face 26*b* are different in shape, and a first timing, at which the first drive cam 24*a* starts to move the first locking plate 16*a* from the position in which the table is prevented from rotating to the position in which the table is allowed to rotate, and a second timing, at which the second drive cam 24*b* starts to move the second locking plate 16*b* from the position in which the table is prevented from rotating to the position in which the table is allowed to rotate, are shifted.

In this way, the respective cam faces 26*a*, 26*b* of the drive cams 24*a*, 24*b* are formed such that respective timings the operating levers 19*a*, 19*b* start to operate are shifted, whereby respective timings of pulling out the pair of right and left locking plates 16*a*, 16*b* from between the table 5 and the frame 2 are shifted. Therefore, a load to the drive shaft 6 that rotates the drive cams 24*a*, 24*b* to operate the right and left locking plates 16*a*, 16*b* in a pulling direction is divided in two times. As a result, a maximum load to the drive shaft is reduced.

Figure 4:
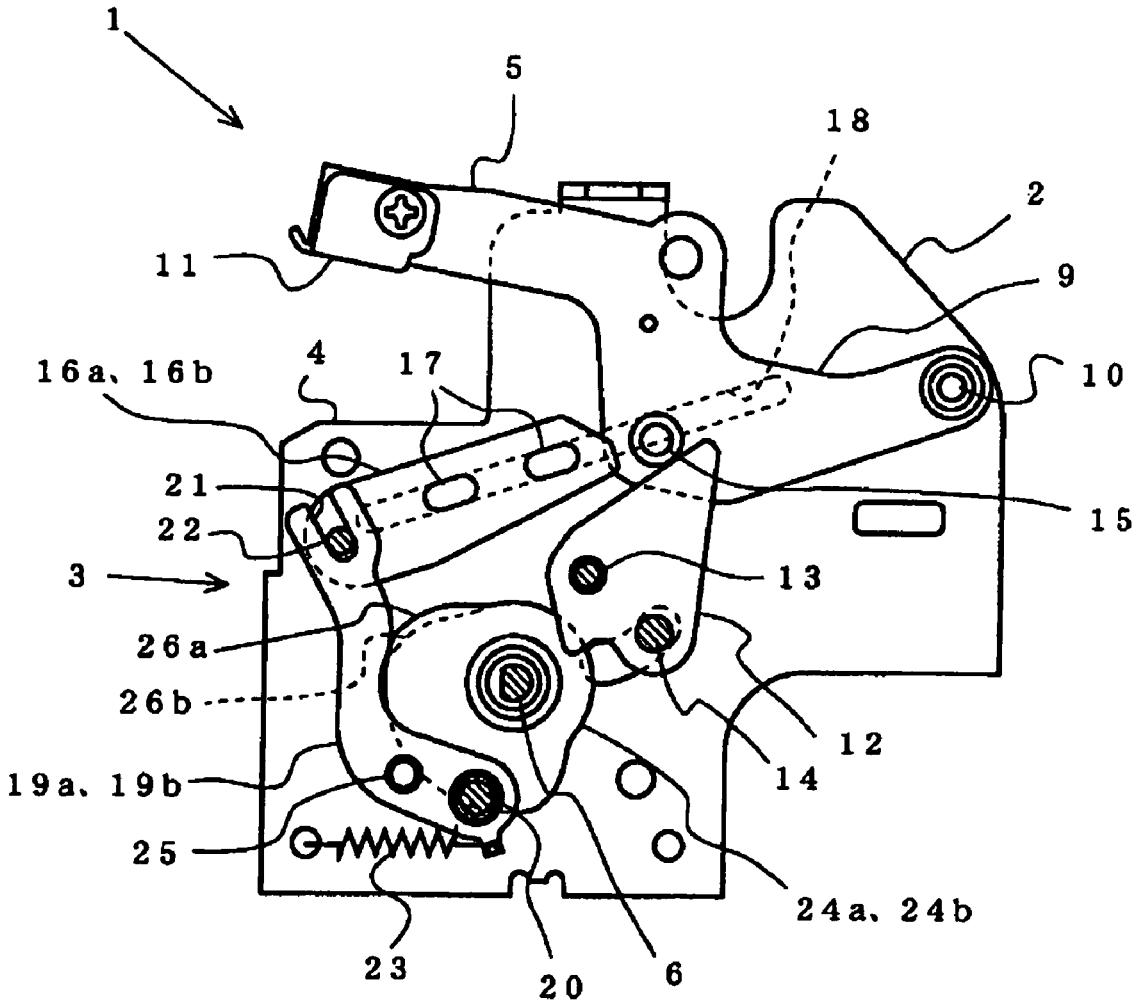
FIG. 4 A side view of the table locking device in a stapling operation is not yet started.

Operations according to the embodiment will be described below with reference to FIGS. 4 to 8. In an initial state, as shown in FIG. 4, the rotation levers 12 engage with the projections 15 formed on the side pieces 9, whereby the table 5 is rotated to a position in which the clincher mechanism 11 formed at the front of the table 5 is rotated clockwise so as to move away from the upper surface 4 of the staple driving section 3. The operating levers 19*a*, 19*b* are held in a position in which the operating levers 19*a*, 19*b* are rotated clockwise by the drive cams 24*a*, 24*b*, and the locking plates 16*a*, 16*b* linked to the operating levers 19*a*, 19*b* are operated toward a left end direction along the elongated holes 18 of the frame 2 and are disposed in the position to be retracted from the upper sides of the projections 15.

Figure 5:
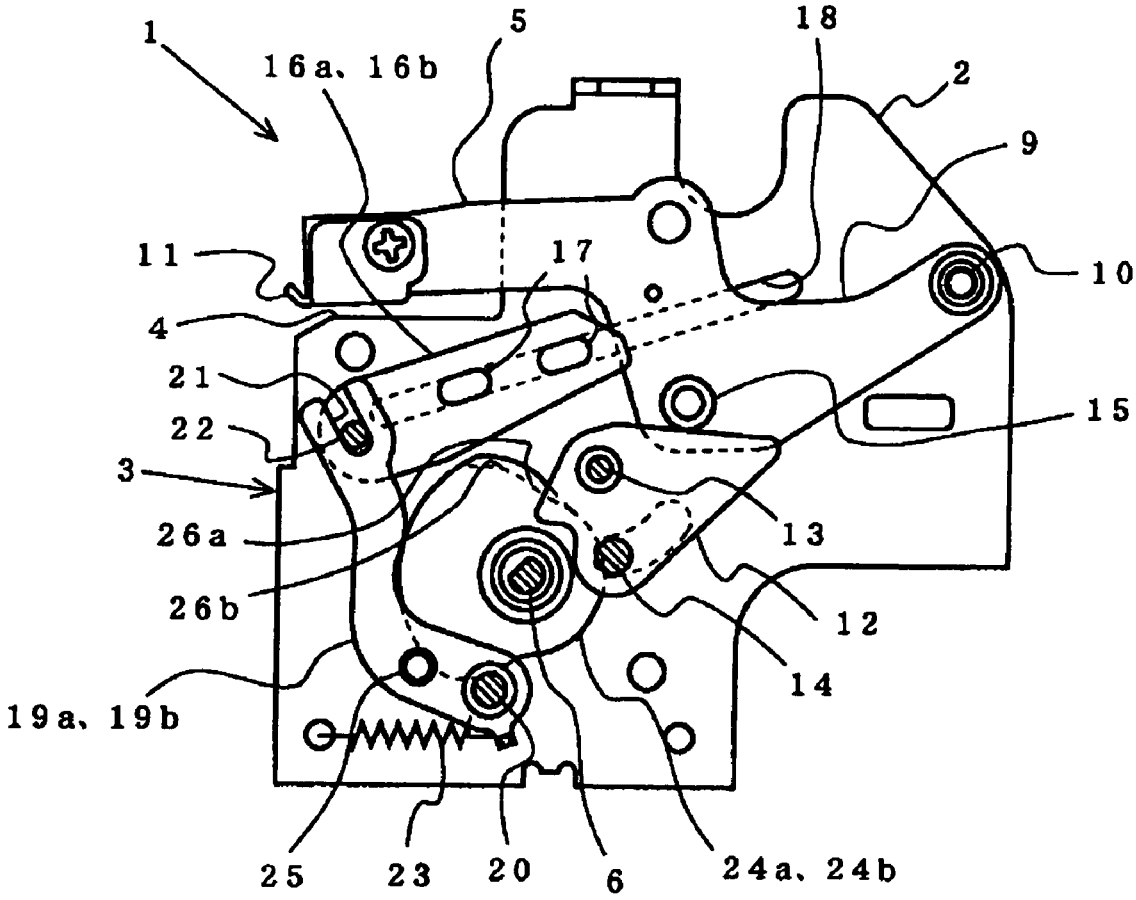
FIG. 5 A side view of the table locking device in which a table is operated in a direction in which sheets of paper to be bound are clamped.

When the sheets of paper to be bound is placed between the upper surface 4 of the staple driving section 3 and the clincher mechanism 11 at the front end of the table 5 and when the stapler 1 is driven so as to staple the sheets of paper to be bound, as shown in FIG. 5, the rotation levers 12 engaging with the projections 15 and holding the table 5 in the position in which the table 5 is rotated clockwise via the projections 15 are rotated clockwise about the supporting shafts 13, whereby the rotation levers 12 disengage from the projections 15, the table 5 rotates counterclockwise about the supporting shafts 10 by the biasing force of the not-shown biasing spring, and the clincher mechanism 11 formed at the front end of the table 5 and the upper surface 4 of the staple driving section 3 hold the sheets of paper to be bound therebetween. Although the drive cams 24*a*, 24*b* are also rotated via the drive shaft 6 by driving the stapler 1, until this point of time, the operating levers 19*a*, 19*b* are held in a position in which the operating levers 19*a*, 19*b* are rotated counterclockwise since the drive pins 25 of the operating levers 19*a*, 19*b* engage with the cam faces 26*a*, 26*b* that are formed on the drive cams 24*a*, 24*b* where radiuses thereof are large.

Figure 6:
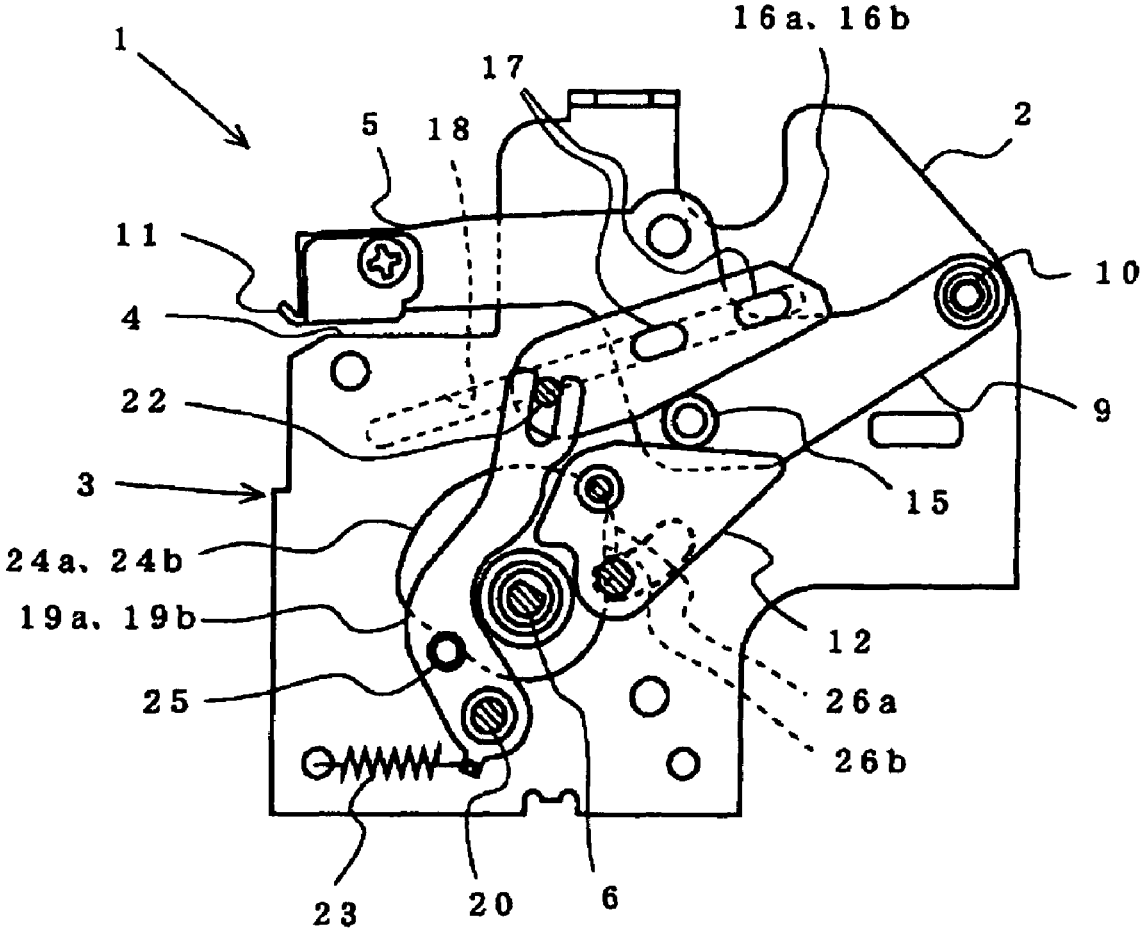
FIG. 6 A side view of the table locking device in which locking plates are fitted between the table and a frame, whereby the table is locked in a closed position.

When the stapling operation of the stapler 1 further proceeds, as shown in FIG. 6, the drive cams 24*a*, 24*b* are further rotated via the drive shaft 6, and the drive pins 25 of the operating levers 19*a*, 19*b* are made to move away from the cam faces 26*a*, 26*b* at the large radius portions of the drive cams 24*a*, 24*b* and face the cam faces 26*a*, 26*b* at small radius portions, whereby the operating levers 19*a*, 19*b* rotate clockwise about the supporting shafts 20 due to the biasing force of the springs 23, so that the locking plates 16*a*, 16*b* linked to the upper ends of the operating levers 19*a*, 19*b* are slid along the elongated holes 18 in the right direction as seen in the figures and are move to the upper sides of the projections 15 formed on the respective side pieces 9 of the table 5.

When the locking plates 16*a*, 16*b* that are slidable along the elongated holes 18 formed in the frame 2 are thus disposed above the projections 15 formed on the respective side pieces 9 of the table 5, the locking plates 16*a*, 16*b* act such that a wedge action between the elongated holes 18 and the projections 15, prevents the table 5 from rotating clockwise about the supporting shafts 10 with respect to the frame 2. Consequently, in this condition, the stapling load, which acts on the table 5 when the legs of the staple struck from the staple driving section 3 toward the sheets of paper to be bound are bent along the rear face of the sheets of paper to be bound, can be held by the locking plates 16*a*, 16*b*.

Figure 7:
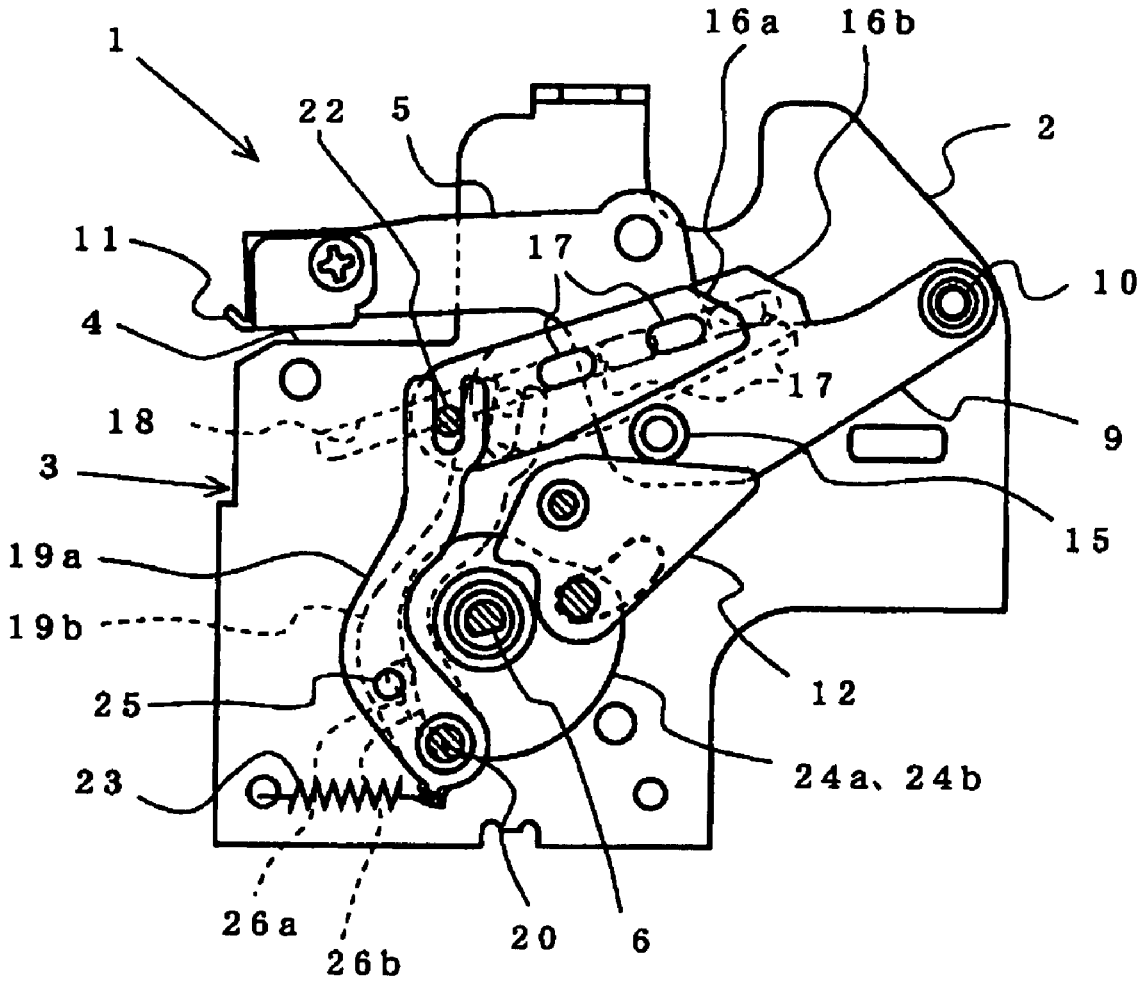
FIG. 7 A side view of the table locking device in which one of the locking plates is being retracted from between the table and the frame.

After the stapling is carried out by bending the legs of the staple struck from the staple driving section 3 along the rear face of the sheets of paper to be bound, as shown in FIG. 7, respective the drive cams 24*a*, 24*b* are further rotated by the drive shaft 6, and the drive pin 25 of one of the operating levers 19*a* engages with the cam face 26*a* of one of the drive cams 24*a* that faces the operating lever 19*a*, thereby causing the operating lever 19*a* to rotate counterclockwise. By the rotation of the operating lever 19*a*, one of the locking plates 16*a* is slid in the left direction as seen in the figure, and is moved toward the position in which the locking plates 16*a* is retracted from the upper side of the projection 15.

At this point of time, the drive pin 25 of the other operating lever 19*b* is held in a position in which operating lever 19*b* is rotated clockwise by the cam face 26*b* of the other drive cam 24*b* that faces the operating lever 19*b*, so that the other locking plate 16*b* is engaged with the projection 15 formed on the other side piece 9 of the table 5. Consequently, the table 5 remains locked in a state in which the table 5 is rotated counterclockwise and the sheets of paper to be bound is held between the table 5 and the staple driving section 3.

Figure 8:
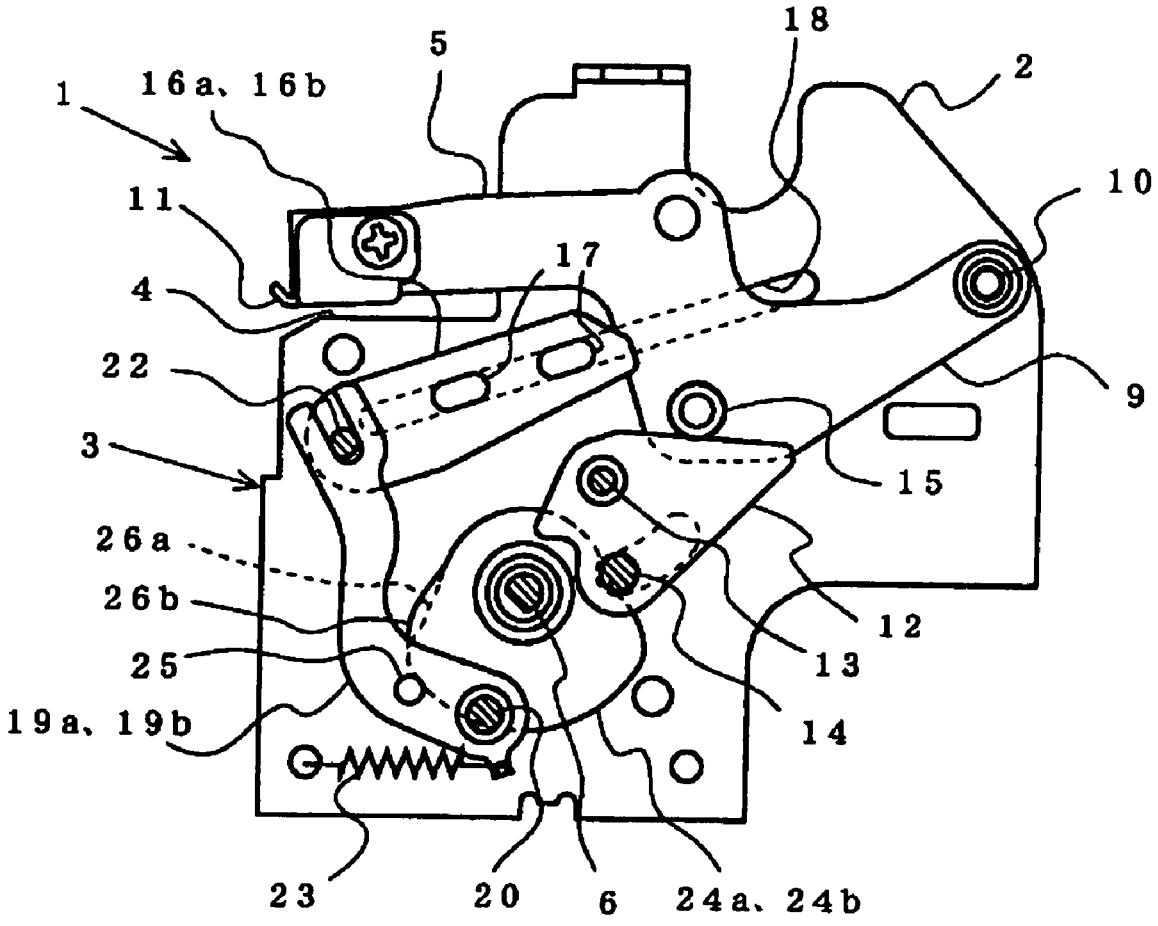
FIG. 8 A side view of the table locking device in which both of the locking plates are slid to respective retracted positions from between the table and the frame.

When the drive cams 24*a*, 24*b* are further rotated by the drive shaft 6, as shown in FIG. 8, the drive pin 25 of the other operating lever 19*b* engages with the cam face 26*b* of the other drive cam 24*b* that faces the operating lever 19*b*, thereby causing the operating lever 19*b* to rotate counterclockwise. By the rotation of the other operating lever 19*b*, the other locking plate 16*b* is slid in the left direction as seen in the figure, and is moved toward the position in which the locking plate 16*b* is retracted from the upper side of the projection 15. In this way, following the locking plate 16*a* described above, the other locking plate 16*b* also retracts from the upper side of the projection 15 formed on the side piece 9 of the table 5, thereby allowing the table 5 to rotate clockwise about the supporting shafts 10.

Subsequently, the rotation levers 12 are rotated about the supporting shafts 13 by not-shown drive cams so as to engage with the projections 15 formed on the respective side pieces 9 of the table 5, and cause the table 5 to rotate clockwise about the supporting shafts 10 via the projections 15, thereby holding the table 5 in the position in which the clincher mechanism 11 formed at the front end of the table 5 is rotated away from the upper surface 4 of the staple driving section 3 as shown in FIG. 4, and completing a series of stapling operations.

While the invention has been described in detail with reference to the specific embodiment, it is obvious to those skilled in the art that various changes and modifications can be made therein without departing from the spirit and scope of the invention.

The present application is based on Japanese patent application (Patent Application No. 2004-284777) filed on Sep. 29, 2004, the content of which is incorporated herein by reference.

INDUSTRIAL APPLICABILITY

According to one or more embodiments of the invention, in a stapler, a table is rotatably supported on a frame via side pieces that are integrally formed on respective sides of the table such that a clincher mechanism faces a staple striking position of a staple driving section. The table is prevented from rotating in the direction in which the clincher mechanism of the table moves away from the staple driving section by inserting a pair of locking plates supported slidably along the frame between the table and the frame. Drive cams operable to drive the locking plates are provided independently for each of the locking plates. Timings, at which the respective drive cams start to operate the corresponding locking plates in a direction in which respective locking plates are pulled out from between the table and the frame, are set to be shifted from one another. For this reason, the right and left locking plates are pulled out from between the table and the frame at different timings. As a result, it is possible to reduce maximum rotation loads to the drive cams that drive the locking plates in the pulling out direction, and to a drive shaft that rotates the drive cams. Thus, a driving current of the electric motor can be reduced, thereby enabling a reduction in noise generated by the electric motor, a reduction in noise resulting from an increase and decrease in the number of revolutions of the electric motor, and a reduction in the size and cost of the electric motor.

The invention claimed is:

1. A stapler comprising:

a frame;

a table which is rotatably supported on the frame;

a pair of side pieces which is integrally formed on respective sides of the table in order to rotatably support the table;

a first and a second locking plates which are slidable along the frame between a position in which the table is prevented from rotating and a position in which the table is allowed to rotate; and a first and a second drive cams operable to drive the first and the second locking plates respectively, wherein a first cam face formed on the first drive cam and a second cam face formed on the second drive cam are different in shape, wherein a first timing, at which the first cam face starts to drive the first locking plate to move from the position in which the table is prevented from rotating to the position in which the table is allowed to rotate is different than a second timing, at which the second cam face starts to drive the second locking plate to move from the position in which the table is prevented from rotating to the position in which the table is allowed to rotate.

2. The stapler according to claim 1, further comprising:

a staple driving section disposed in a lower portion of the frame; and a clincher mechanism disposed at a front portion of the table, wherein the clincher mechanism faces a staple striking position of the stapledriving section, and the clincher mechanism moves toward or moves away from an upper surface of the staple driving section in accordance with a rotation of the table.

3. The stapler according to claim 2, wherein, when the first and second locking plates are in the position in which the table is prevented from rotating, the clincher mechanism is prevented from moving in a direction away from the staple driving section.

4. The stapler according to claim 3, wherein the table is biased in a direction in which the clincher mechanism moves toward the stapledriving section.

5. The stapler according to claim 4, further comprising:

a rotation lever which is rotatably supported on the frame; and a projection which is engageable with the rotation lever, the projection being formed on each of the pair of side pieces, wherein the table rotates in the direction in which the clincher mechanism moves away from the stapledriving section in accordance with the rotation of the rotation lever.

6. The stapler according to claim 5, wherein each of the first and second locking plates engages with the corresponding projection in the position in which the table is prevented from rotating.

* * * * *